US006476554B1

(12) United States Patent
Snijkers et al.

(10) Patent No.: US 6,476,554 B1
(45) Date of Patent: Nov. 5, 2002

(54) PLASMA DISPLAY

(75) Inventors: Rob Snijkers, Landgraaf (NL); Markus Klein, Freiburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/255,631

(22) Filed: Feb. 22, 1999

(30) Foreign Application Priority Data

Feb. 27, 1998 (DE) ..... 198 08 268

(51) Int. Cl.[7] ..... H01J 17/49

(52) U.S. Cl. ..... 313/586; 313/492; 313/493; 313/587

(58) Field of Search ..... 313/586, 587, 313/492, 493

(56) References Cited

U.S. PATENT DOCUMENTS 5,041,759 A * 8/1991 Kwon et al. ..... 313/495

FOREIGN PATENT DOCUMENTS

| | | | | |
|---|---|---|---|---|
| EP | 0764965 A2 | | 3/1997 | ..... H01J/17/49 |
| EP | 0782167 A2 | | 7/1997 | ..... H01J/17/49 |
| FR | 2650425 | * | 2/1991 | ..... C09F/9/313 |
| JP | 8250029 | | 9/1926 | ..... H01J/11/00 |
| JP | 05-234520 A | * | 9/1993 | ..... H01J/11/02 |

OTHER PUBLICATIONS

Japanese Abstract 10275563, "Plasma Display Panel", Int. Class H01J Nov. 2002.

"AC Surface Electric Discharging Type Plasma Display Panel and Manufacture Thereof", Patent Abstract of Japan, Publication Number 05234520, Date Sep. 10, 1993, Int'l Class H01J Nov. 2002.

"DC Plasma Display Panel", Patent Abstract of Japan, Publication No, 06084468, Date Mar. 25, 994, Int'l class H01J 17/49.

"Gas Discharge Panel", Publication No. 03226943, Date Oct. 7, 1991 Int'l Class H01J 17/49.

* cited by examiner

*Primary Examiner*—Frank G. Font
*Assistant Examiner*—Andrew H. Lee

(57) ABSTRACT

A plasma display comprises a front panel, a rear panel, and, arranged therebetween, a number of gas-containing plasma cells separated from each other by partitions. The plasma cells each comprise a plasma region between two discharge electrodes and means arranged between the discharge electrodes for locally substantially narrowing the plasma region.

3 Claims, 4 Drawing Sheets

PLASMA DISPLAY

FIELD OF THE INVENTION

Figure 1:
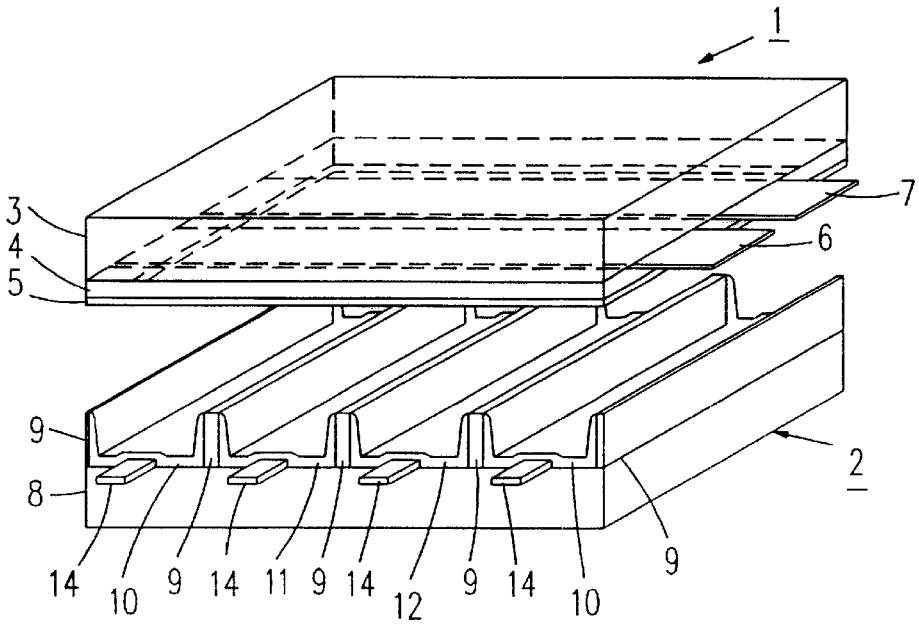
Fig.1 PRIOR ART

The invention relates to a plasma display comprising a front panel, a rear panel and, arranged therebetween, a number of gas-containing plasma cells which are separated from each other by partitions, in which plasma cells a plasma may be formed, in a plasma region, between two discharge electrodes.

BACKGROUND AND SUMMARY OF THE INVENTION

Such a plasma display is known, for example, from EP 764 965 A2. Such a plasma display customarily comprises a matrix of plasma cells (microcavities) in which a gas discharge is ignited. This gas discharge preferably generates radiation in the UV range, which radiation is converted by a phosphor layer present in the plasma cell into visible red, green or blue light. This visible light can be transmitted to the exterior through the transparent glass front panel.

Apart from the high manufacturing cost and the expensive driver electronics for the high-voltage drive, the low efficiency, particularly the very low discharge efficiency, is regarded to be a drawback of such plasma displays.

Therefore, it is an object of the invention to provide a plasma display with an improved discharge efficiency and a higher efficacy. In accordance with the invention, this object is achieved by the plasma display described in claim 1.

The high losses in known plasma displays can be attributed, in particular, to the fact that after the ignition of the gas discharge, a layer is formed in the vicinity of the discharge electrode acting as a cathode, which layer is commonly referred to, in the case of glow discharges, as cathode trap. In the region of this layer facing the cathode, a very high electric field strength in combination with a low ion and electron density is observed. In said region, the current is carried, in particular, by the ions which outnumber the electrons. As a result of the high electric field strength, ions in this region are accelerated substantially and release their energy through elastic collisions to the gas molecules and the walls.

The inventive means for locally narrowing the plasma region are suitably provided at locations where there is a high electron density, i.e. not in the direct vicinity of the cathode. By narrowing the plasma region, a region having a high field strength is generated in which the electrons are accelerated. Thus, in a region having a high electron density, also the average electron energy levels are high, so that in this region electric energy is efficiently converted to excitation energy and hence radiation energy. In this region, a quasi-neutral state again prevails, the current flow, however, being predominantly carried by the electrons. Consequently, a greater proportion of the available power is coupled into regions having a high efficiency, so that the overall efficacy of the plasma display is increased.

The object in accordance with the invention is achieved also by a plasma display as claimed in claim 2. By extending the discharge path (i.e. the path where the discharge between the discharge electrodes takes place) between the discharge electrodes, it is achieved that the cathode range referred to as cathode trap, in which the number of electrons and ions are approximately equal, becomes larger relative to the other regions between the discharge electrodes. Consequently, the zone which is subject to losses becomes relatively smaller.

As a result, UV radiation can be generated more efficiently and the losses occurring in the cathode trap in front of the cathode are smaller.

The inventive solutions as claimed in claim 1 and 2 are based on the idea in accordance with the invention that an increase of the discharge efficiency and a higher efficacy can be achieved by providing means which bring about that in a region between the discharge electrodes the electric field is as strong as possible and that said region contains as many electrons as possible, so that as many electrons as possible can be excited.

The invention is preferably employed in AC plasma displays, in which the plasma cells are driven by an alternating voltage, and in which the discharge electrodes are covered, as claimed in claim 4, with a dielectric layer. The invention can in principle also be used however in DC plasma displays in which the discharge electrodes are not covered with a dielectric layer.

The advantageous further embodiments of the invention as claimed in claims 5 and 6 constitute simple solutions which, dependent upon the location where they are applied and their dimensions, may bring about both a local narrowing of the plasma region and an extension of the discharge path.

In other types of plasma displays, in which a discharge electrode is arranged on the front panel as well as on the rear panel, the means for narrowing the plasma region may, as claimed in claim 7, also take the form of a diaphragm arranged at the partitions for separating the individual plasma cells from each other.

Since, in AC plasma displays the symmetry of the discharge with regard to the polarity, i.e. the similarity of the plasma near the cathode and the anode, is very important, said means are preferably centrally arranged between the discharge electrodes, as claimed in claim 8. This does not affect the symmetry. It is also feasible, however, to deliberately use plasma-asymmetry, and deliberately arrange the means asymmetrically.

Preferably, the means used for narrowing are made of a dielectric material, as claimed in claim 9. However, it is alternatively possible to use other materials, such as metal or metal with a dielectric coating, thus enabling the means for narrowing or path extension to be given a fixed potential.

The inventive embodiment as claimed in claim 10 is very easy to manufacture and adjust. If the recesses are suitably embodied, as claimed in particular in claim 11, it is even possible to provide a number of narrowed portions in the plasma region and simultaneously extend the discharge path.

These and other aspects of the invention will be apparent from and elucidated with reference to the embodiments described hereinafter.

BRIEF DESCRIPTION OF THE DRAWING FIGURES

Figure 2:
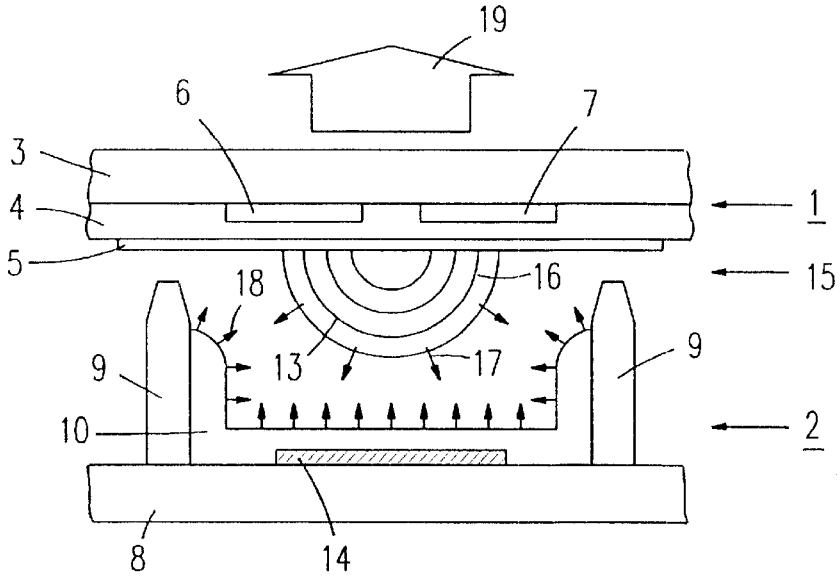
Fig.2 PRIOR ART
Figure 3:
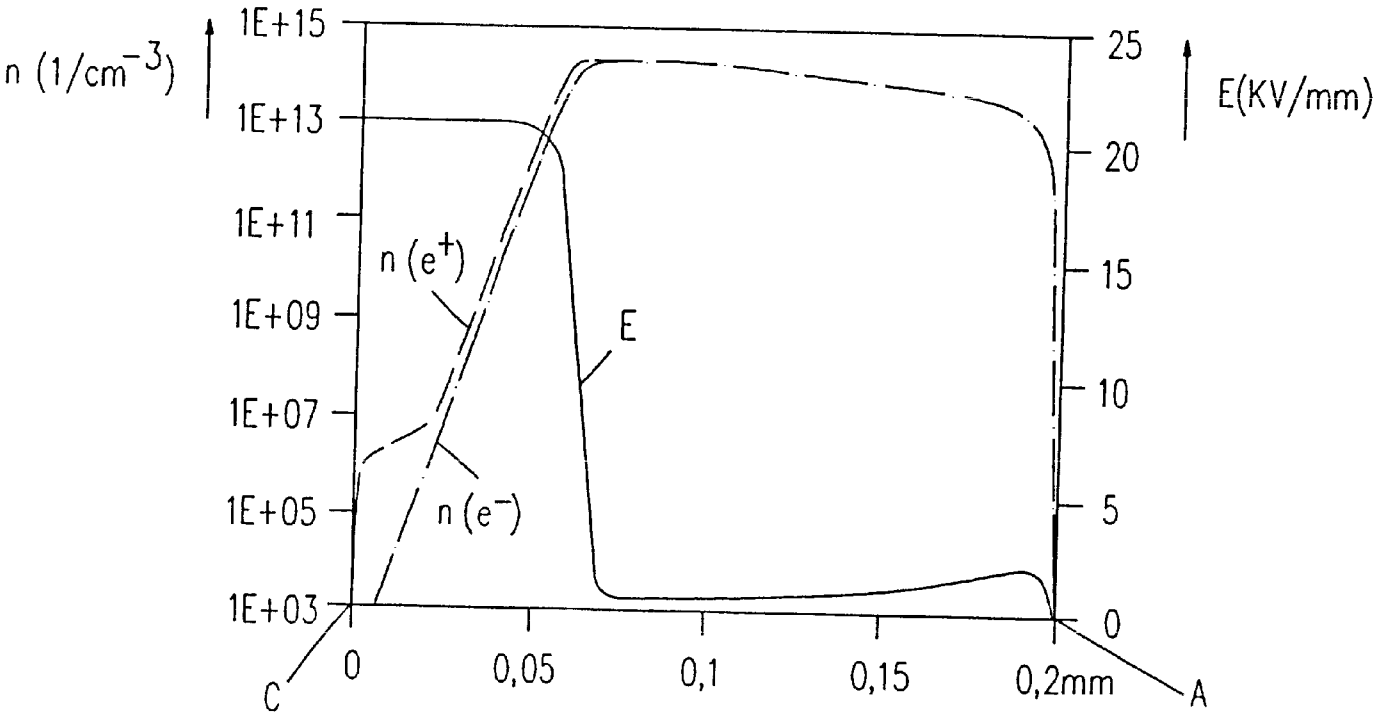
Figure 4:
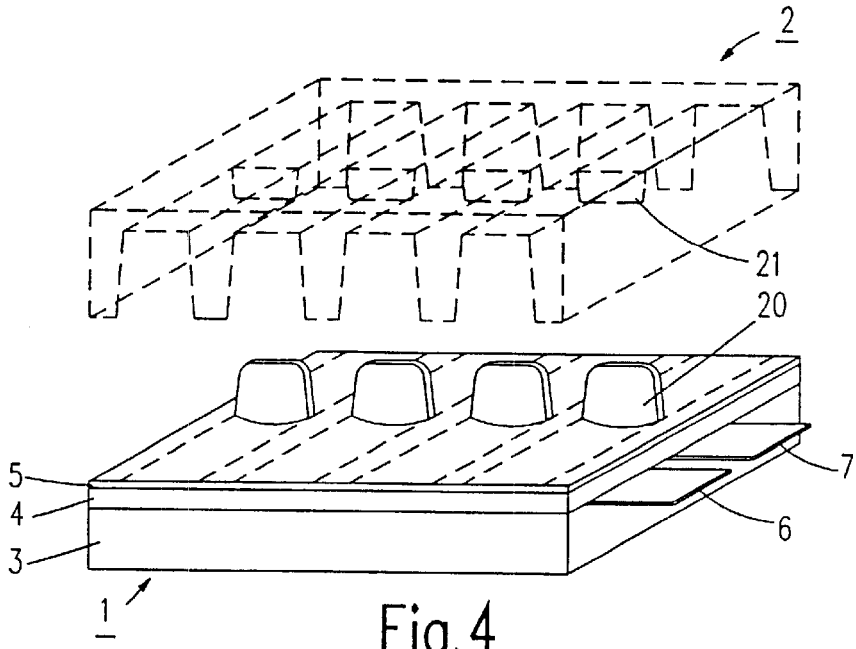
Figure 5:
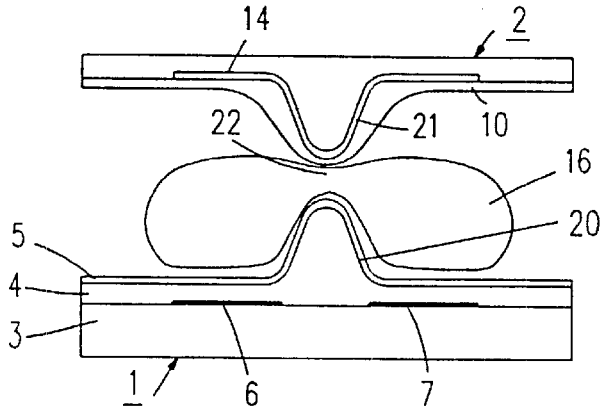
Figure 6:
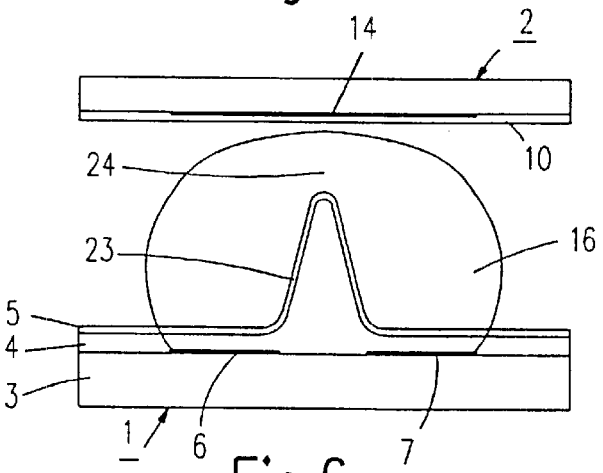
Figure 7:
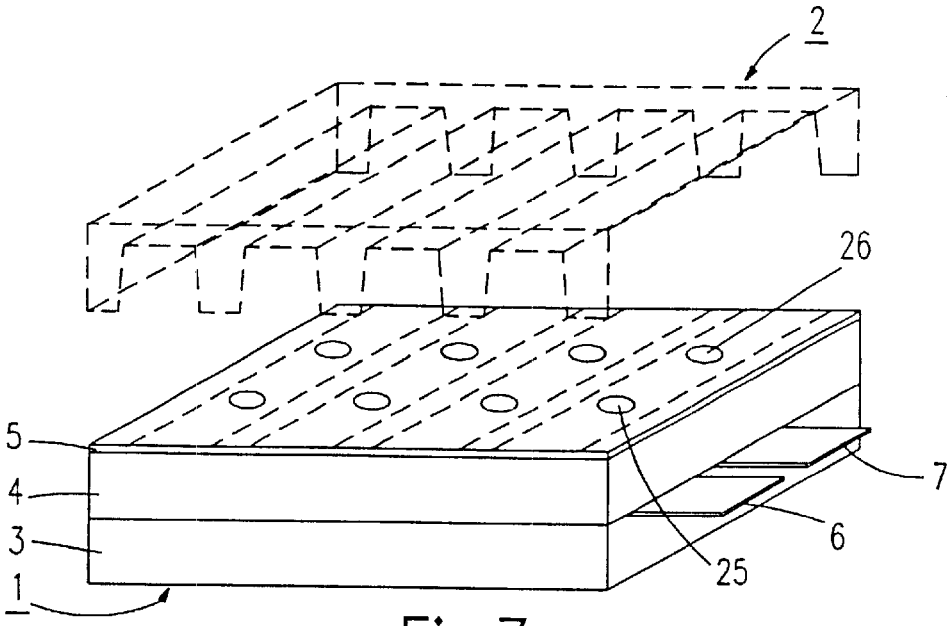
Figure 8:
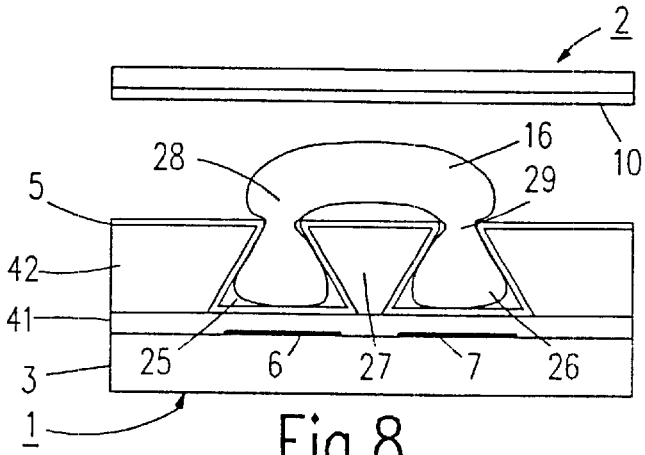
Figure 9:
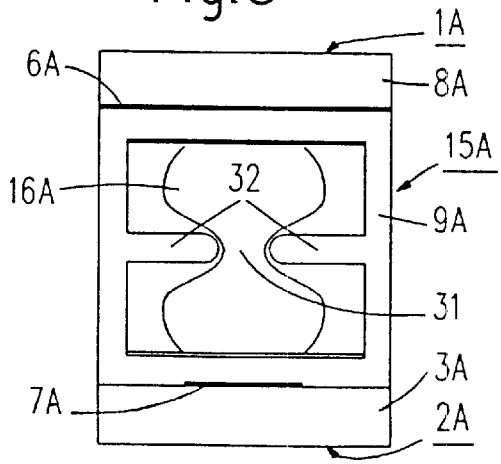

In the drawings:

FIG. 1 shows the structure of a known plasma display,

FIG. 2 shows the operating principle of an individual plasma cell in such a plasma display, FIG. 3 shows the variation of the electron and ion density as well as the variation of the electric field strength between the discharge electrodes, FIG. 4 shows the structure of a plasma display in accordance with the invention, FIG. 5 shows a plasma display cell in a plasma display in accordance with FIG. 4, FIG. 6 shows a further embodiment of a plasma cell in a plasma display in accordance with the invention, FIG. 7 shows the structure of an alternative plasma display in accordance with the invention, FIG. 8 shows a plasma cell in a plasma display in accordance with FIG. 7, and FIG. 9 shows an embodiment of a plasma cell with facing discharge electrodes in a plasma display in accordance with the invention.

DETAILED DESCRIPTION

FIG. 1 is a sectional view of an AC plasma display which comprises a front panel 1 and a rear panel 2. The front panel 1 includes a glass plate 3 onto which a dielectric layer 4 is provided, which dielectric layer 4 in turn is provided with a thin protective layer 5 (generally of MgO). On the glass plate 3, parallel, strip-shaped transparent discharge electrodes 6, 7 are provided in such a manner that said electrodes are covered by the dielectric layer 4. The rear panel 2 includes a glass plate 8 onto which parallel, strip-shaped address electrodes 14 are provided so as to extend at right angles to the discharge electrodes 6, 7. Said address electrodes are covered with phosphor layers 10, 11, 12 having one of the three primary colors red, green, blue. The individual phosphor layers 10, 11, 12 are separated from each other, preferably, by partitions (barriers) 9 of a dielectric material.

The structure of an individual plasma cell 15 in such a plasma display is shown in FIG. 2. In order to show the two discharge electrodes 6, 7, the front panel 1 is rotated through 90° relative to the representation of FIG. 1. A gas, preferably an inert gas mixture (He, Ne, Xe, Kr) is present in the discharge cavity and between the discharge electrodes, one of which serves as a cathode or an anode. After ignition of the surface discharge, enabling charges to flow on a discharge path 13 situated between the discharge electrodes 6, 7 in the plasma region, a plasma forms in the plasma region 16, which preferably generates radiation 17 in the UV region (or VUV region (Vacuum-UV region)). This UV radiation 17 causes the phosphor layer 10 to become luminescent, said layer emitting visible light 18 in one of the three primary colors, which light is sent out through the front panel 1, thus forming a luminous pixel on the display.

The dielectric layer 4 covering the transparent discharge electrodes 6, 7 is used, inter alia, in AC-plasma displays to counteract a direct discharge between the discharge electrodes 6, 7 consisting of a conductive material (metal, generally ITO (indium-doped tin oxide)), and hence to counteract the formation of a light arc when the discharge is ignited. If the electric field strength in the plasma region 16 increases to a level above the ignition field strength, then the conductivity of this region increases very rapidly as a result of the generation of charge carriers by ionization. In addition, the transported charge carriers deposited on the dielectric layer reduce the inner field strength to such an extent that the electron losses overcompensate the electron gain by ionization and the discharge is automatically interrupted. FIG. 3 is a qualitative representation of the variation of the electron density ($n(e^-)$), the ion density ($n(e^+)$) and of the electric field E between the cathode C and the anode A shortly after ignition. In the region just in front of the cathode C, a drastic disturbance of the quasi-neutrality can be observed, i.e. the ion and electron densities differ from each other while, at the same time, the electric field strengths E are very high. Although the electrons have a much higher mobility than the ions, in this region a large part of the current, which at this point can be represented as the sum of the electron current and the ion current, must be carried by the ions. Since, however, also the ion density in this region is relatively low, very high field strengths are required. Consequently, the ions are accelerated in this electric field and release their energy predominantly via elastic collisions to the gas and the walls. Under the geometrical boundary conditions of the plasma display, this conversion of electric energy into thermal energy leads to a substantial loss of up to 60%.

FIG. 4 is a sectional view of the structure of a plasma display in accordance with the invention, in which the above-described drawbacks are avoided. In this plasma display, both on the front panel 1 and on the rear panel 2, upright, opposite walls 20, 21 are arranged between the discharge electrodes 6, 7, which walls are preferably made of a dielectric material. As is shown, particularly in FIG. 5 in which an individual plasma cell of such a plasma display is shown, these walls 20, 21 cause the plasma region 16 to be centrally reduced between the discharge electrodes 6, 7 at the location of spot 22. As a result, in the region of the narrowing 22, where the electron density (see FIG. 3) is high, a region having a high electric field strength is generated in which the electrons are accelerated. This causes an increase of the average electron energy levels in this region, so that electric energy is efficiently converted to excitation energy and hence radiation energy.

An alternative embodiment of the invention is shown in FIG. 6. In said Figure, only on the front panel 1, such a wall 23 is centrally arranged between the discharge electrode 6, 7, which wall, however, comes closer to the rear panel 2. Also with only one such wall 23, a narrowing of the plasma region 16 at the location 24 can be achieved. Dependent upon the height of the wall 23, or of the wall 20 in FIG. 5, also an extension of the discharge channel between the discharge electrodes 6, 7 can be achieved, thus enabling UV radiation to be generated more efficiently. This can be attributed to the fact that the extension of the path causes all regions (see FIG. 3) to be widened, including the inefficient region just in front of the cathode in which the ions clearly outnumber the electrons. This region, however, is widened by a smaller factor than the consecutive (efficient) region in which the number of electrons and ions are approximately in balance.

An embodiment of a plasma display in accordance with the invention which can be readily manufactured is shown in FIG. 7. In said Figure, the dielectric layer 4 of the front panel 1 is provided with holes or recesses 25, 26 above the discharge electrodes 6, 7. When the discharge is ignited, the plasma forms in these recesses 25, 26 as well as above the intermediate dielectric wall 27 (see FIG. 8). As shown in FIG. 8, the recesses 25, 26 may be embodied so as to be truncated with a circular cross-section, said cross-section decreasing towards the rear panel 2, so that two local narrowings 28, 29 are formed. Also in this embodiment, an additional extension of the discharge path is possible.

Such a front panel 1 may be manufactured in a step-by-step manner. In a first step, a first dielectric layer 41 is provided in a homogeneous thickness onto the glass plate 3, whereafter, in a second step, a further dielectric layer 42 or a dielectric plate is applied to said first dielectric layer. This layer 42 may be provided, either previously or afterwards, with the proper hole structure, for example, by means of sandblasting or burning-in.

Also in another type of plasma displays, in which the discharge electrodes are situated opposite each other, use can be made of the invention. A plasma cell 15A of such a plasma display is shown in FIG. 9. The discharge electrode 6A is provided on the glass plate 8A of the front panel 1A, the discharge electrodes 7A is provided at right angles to 6A onto the glass plate 3A of the rear plate 2A. In this Figure, the partitions 9A are provided, centrally between the electrodes 6A, 7A, with a ring-shaped dielectric diaphragm 32 which leaves a circular aperture 31. The plasma region 16A is locally narrowed at this location in dependence upon the opening of the diaphragm 32. It is conceivable that in this embodiment a number of such diaphragms 32 are provided at different locations in order to narrow the plasma 16A in a number of locations. Similarly, also in other embodiments of the invention, a plurality of local narrowings can be provided.

The invention can also be used in an alternative embodiment, which is not shown, in which both discharge electrodes are arranged on the rear panel. In this case, however, the visible light must pass through the phosphor layers.

What is claimed is:

1. A plasma display comprising a front panel, a rear panel, and, arranged therebetween, a number of gas-containing plasma cells separated from each other by partitions, said plasma cells comprising a plasma region between two discharge electrodes and means arranged between the discharge electrodes for one of locally narrowing the plasma region and extending the discharge path between the discharge electrodes, wherein a discharge electrode is arranged on the front panel and on the rear panel, and the means comprise a diaphragm arranged at the partitions.

2. The plasma display of claim 1, wherein said means consists of a means for locally narrowing said plasma region.

3. The plasma display of claim 1, wherein said means consists of a means for extending the discharge path between the discharge electrodes.

* * * * *